United States Patent [19]

Nauheimer

[11] 4,416,371

[45] Nov. 22, 1983

[54] GARMENT CONTAINER

[75] Inventor: James F. Nauheimer, Chicago, Ill.

[73] Assignee: Container Corporation of America, Chicago, Ill.

[21] Appl. No.: 357,633

[22] Filed: Mar. 12, 1982

[51] Int. Cl.[3] ..... B65D 85/18

[52] U.S. Cl. ..... 206/289; 206/279; 206/294; 229/34 HW

[58] Field of Search ..... 206/289, 290, 300, 279, 206/294, 297; 229/34 HW

[56] References Cited

U.S. PATENT DOCUMENTS

| | | | |
|---|---|---|---|
| 3,999,657 | 12/1975 | Doskocil | 206/289 |
| 4,060,169 | 11/1977 | Hildebrand et al. | 206/289 |
| 4,085,842 | 4/1978 | Beck | 206/289 |
| 4,300,687 | 11/1981 | Gardner et al. | 206/279 |
| 4,318,472 | 3/1982 | Nauheimer et al. | 206/289 |
| 4,342,389 | 8/1982 | Bethune et al. | 206/290 |

FOREIGN PATENT DOCUMENTS

| | | | |
|---|---|---|---|
| 1427904 | 1/1966 | France | 229/34 HW |
| 1514346 | 6/1978 | United Kingdom | 229/34 HW |

*Primary Examiner*—William T. Dixson, Jr.
*Assistant Examiner*—Brenda J. Ehrhardt
*Attorney, Agent, or Firm*—Richard W. Carpenter; Davis Chin

[57] ABSTRACT

A garment container having hollow end wall structures adapted to receive a plurality of garment hangers.

3 Claims, 5 Drawing Figures

GARMENT CONTAINER

BACKGROUND OF THE INVENTION

1. Field of the Invention

This invention relates to shipping containers, and more particularly to a container adapted to hold a plurality of garments on hangers secured to the ends of the container.

2. Description of the Prior Art

A prior art search directed to the subject matter of this application in the United States Patent and Trademark Office revealed the following U.S. Pat. Nos. 2,688,433; 2,707,587; 2,811,298; 2,989,233; 3,259,229; 3,645,437; 3,904,106; 4,060,169; 4,085,842; 4,119,197.

None of the prior art patents uncovered in the search disclosed the unique end wall arrangement of the present invention wherein a pair of hollow sections projecting from opposed side walls are positioned in overlapping, telescoping relation with each other.

SUMMARY OF THE INVENTION

This invention relates to garment boxes and especially is concerned with a novel end wall construction for garment box which will accommodate a plurality of garments to be placed on individual hangers the ends of which are received within slots in the end walls of the container.

A specific object of the invention is the provision, in the container of the type described, of a unique end wall arrangement including a pair of hollow sections extending from the opposed side walls and positioned in telescoping, overlapping relation with each other and with another end wall panel to provide a structure which requires no outside securing means such as glue, tape or staples.

These and other objects of the invention will be apparent from an examination of the following description and drawings.

Figure 1:
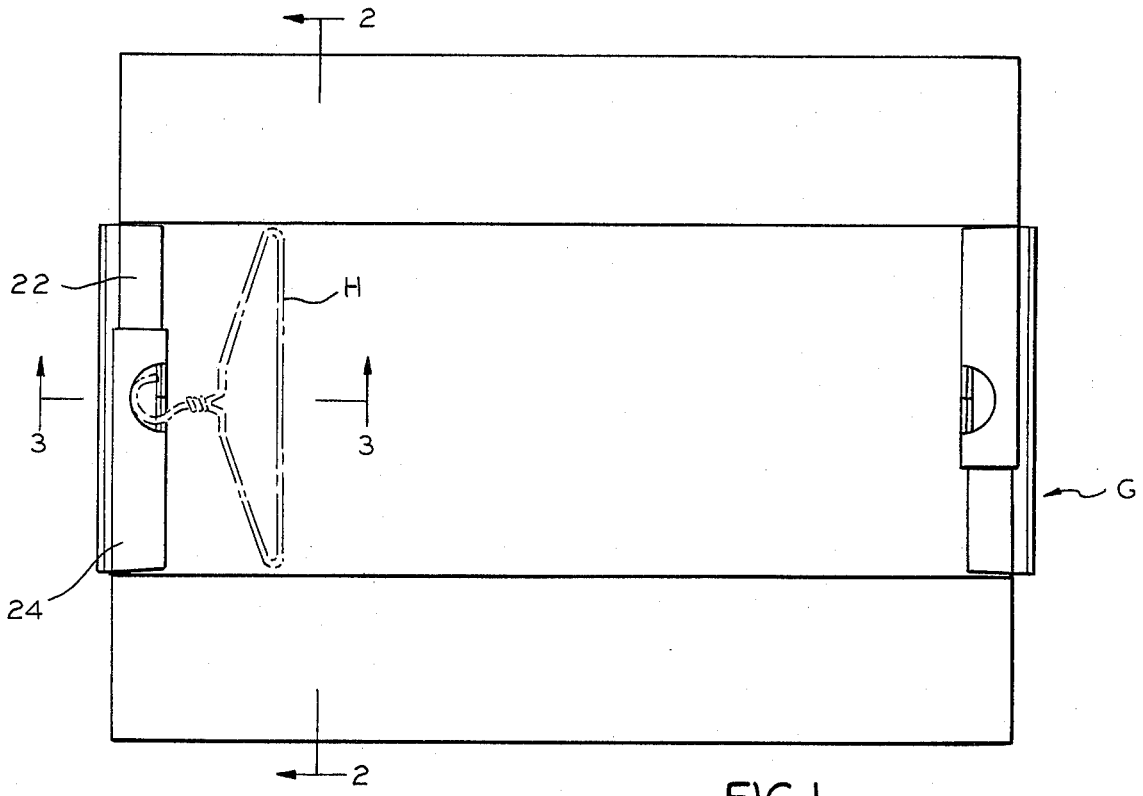
FIG. 1 is a fragmentary plan view of a container embodying features of the invention, as shown in the open position.
Figure 2:
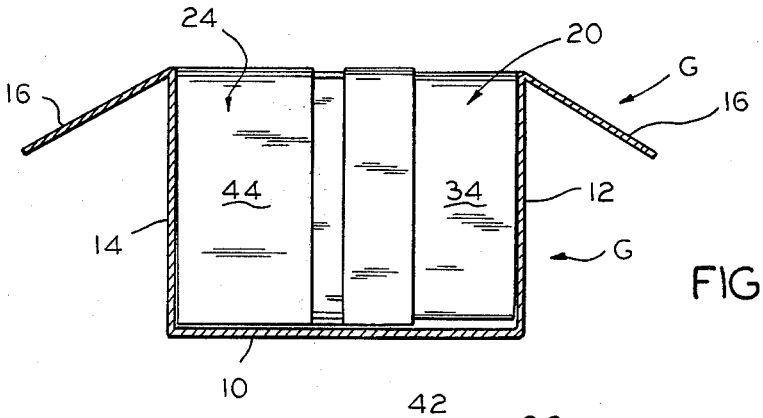
FIG. 2 is a fragmentary transverse vertical section taken on line 2—2 of FIG. 1.
Figure 3:
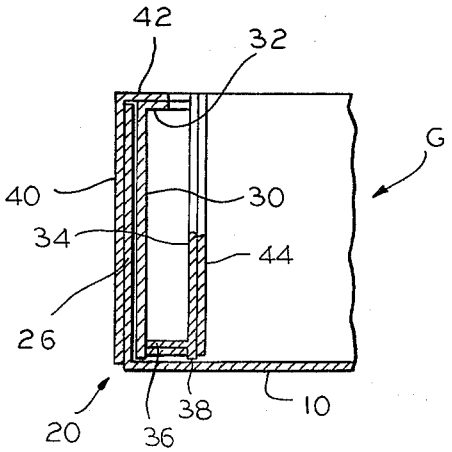
FIG. 3 is a fragmentary longitudinal section taken on line 3—3 of FIG. 1.

It will be understood that, for purposes of clarity, certain elements may have been intentionally omitted from certain views where they are believed to be illustrated to better advantage in other views.

DESCRIPTION OF THE PREFERRED EMBODIMENT

Referring now to the drawings for a better understanding of the invention, it will be seen that the novel garment box, indicated generally at G, is adapted to hold a plurality of garments arranged on hangers H which are received within slots of the opposed end walls of the container.

Figure 5:
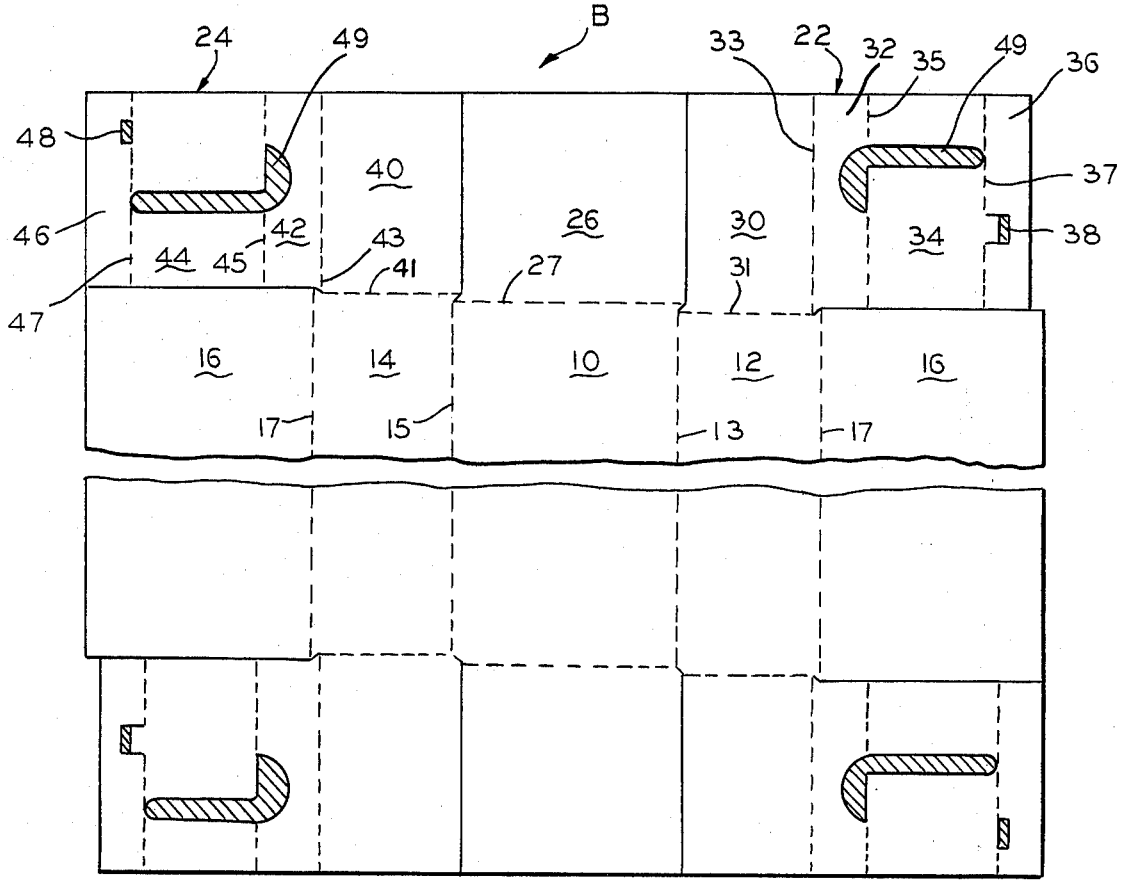
FIG. 5 is a plan view of a blank of foldable sheet material from which the structure illustrated in the other views may be formed.

The container G may be formed from a unitary blank B of foldable sheet material illustrated in FIG. 5. As will be described later in the specification, the novel construction of the container makes it entirely self-locking and self-contained, so that no outside securing means such as staples, glue or tape are required to hold the container together in assembled position.

Figure 4:
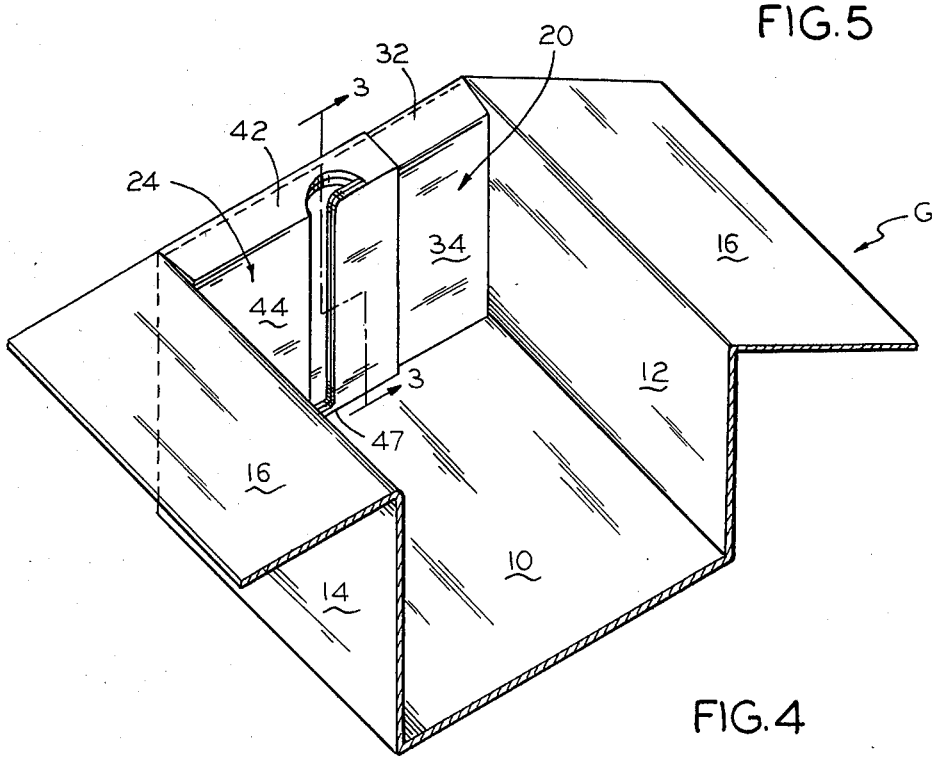
FIG. 4 is a fragmentary perspective view of the structure illustrated in FIG. 1.

As best seen in FIGS. 4 and 5, container G includes a bottom wall panel 10, having a pair of opposed first and second side wall panels 12 and 14 foldably joined to opposed side edges thereof on fold lines 13 and 15 and extending upwardly therefrom. A pair of top wall panels 16 are foldably joined to the upper edges of side wall panels 12 and 14 along fold lines 17.

Still referring to FIG. 4, it will be seen that the novel portion of the container resides in the unique construction of the end walls 20.

Each of the end walls 20 includes a pair of hollow inner and outer sections 22 and 24, respectively, together with a separate intermediate end wall panel 26 which is foldably joined along a fold line 27 to the related end edge of bottom wall panel 10.

End wall inner section 22 includes: an outer panel 30, foldably joined on fold line 31 to an adjacent end edge of related side wall panel 12; a relatively narrow upper panel or flange 32, foldably joined on fold line 33 to the upper edge of outer panel 30; an inner panel 34, foldably joined on fold line 35, to the forward edge of upper panel 32; and a bottom panel or flange 36, foldably joined on fold line 37 to the lower edge of inner panel 34. Bottom flange 36 also includes a lock tab 38 the purpose of which is described later in the specification.

Outer hollow section 24 is similar in construction to inner section 22 and includes: an outer panel 40, foldably joined on fold line 41 to an adjacent end edge of side wall panel 14; an upper panel or flange 42, foldably joined on fold line 43 to the upper edge of outer panel 40; an inner panel 44, foldably joined at its upper edge on fold line 45 to an inner edge of upper panel 42; and a bottom flange 46, foldably joined on fold line 47 to the lower edge of inner panel 44. Bottom flange 46 includes a slot 48 adapted to receive lock tab 38 of inner section 22.

Outer section 24 also includes a J-shaped slot 49 in panels 42 and 44 which cooperates with a similar slot 39 in panels 32 and 34 of inner section 22 to form a common slot, as best seen in FIG. 4, which is adapted to receive a plurality of garment hangers when the structure is in assembled condition.

In order to assemble the structure, the side wall panels are folded upwardly at right angles to the bottom wall panel and the end wall sections are folded inwardly and upwardly to form generally rectangular structures which are arranged in overlapping, telescoping relation, with the related end wall intermediate panel 26 interposed between outer panel 30 of section of 22 and outer panel 40 of section 24.

Thus, there is provided an interlocking relationship between the inner and outer sections and related end wall intermediate panel in addition to the lock tab and slot interconnection between the respective bottom flanges of the sections. Because of this novel construction no outside securing means such as glue, staples or tape are required to maintain the container in a erected condition.

What is claimed is:

1. In a collapsible container adapted to hold a plurality of garments on hangers, formed from a unitary blank of foldable sheet material, such as paperboard, and being self-contained so as to require no outside securing means to maintain it in erected position, the combination of:

(a) a bottom wall panel having pairs of opposed side and end walls foldably joined thereto and to each other and upstanding therefrom to form a boxlike structure;

(b) at least one of said end walls including a pair of hollow sections extending toward each other for opposed side walls in partially overlapping, telescoping relation;

(c) each of said hollow sections including:

(i) an outer panel foldably joined to an adjacent end edge of a related side wall panel;

(ii) an upper panel foldably joined to an upper edge of said outer panel and extending inwardly therefrom;

(iii) an inner panel foldably joined to an inner edge of said upper panel and extending downwardly therefrom;

(iv) a bottom flange foldably joined to a lower edge of the inner panel and extending outwardly therefrom over the bottom wall panel;

(d) the upper and inner panels of said sections having aligned hanger receiving openings therein;

(e) said sections having interlocking engagement with each other to maintain said container in erected position without requiring outside securing means; and (f) one of the bottom flanges of said sections having a locking tab and the other bottom flange of said sections having a slot, said slot being adapted to receive said locking tab to provide a locking engagement.

2. A container according to claim 1, wherein each of said end walls includes an intermediate panel foldably joined to an end edge of said bottom wall panel and disposed to extend upwardly therefrom between the outer panels of the adjacent hollow sections.

3. A container according to claim 1, wherein each of the end walls includes a pair of hollow sections.

* * * * *